US005752621A

United States Patent [19]

Passamante

[11] Patent Number: 5,752,621

[45] Date of Patent: May 19, 1998

[54] SMART AUTOMATIC MEDICATION DISPENSER

[75] Inventor: Anthony P. Passamante, Oreland, Pa.

[73] Assignee: Eigen Technology Inc., Oreland, Pa.

[21] Appl. No.: 616,079

[22] Filed: Mar. 14, 1996

Related U.S. Application Data

[63] Continuation-in-part of Ser. No. 407,203, Mar. 20, 1995, abandoned.

[51] Int. Cl.[6] ..... G07E 11/00

[52] U.S. Cl. ..... 221/13; 221/131

[58] Field of Search ..... 221/2, 3, 7, 9, 221/13, 15, 92, 131, 277, 123

[56] References Cited

U.S. PATENT DOCUMENTS 4,748,600 5/1988 Urquhart ..... 221/2

5,047,948 9/1991 Turner ..... 221/9

*Primary Examiner*—Kenneth Noland

[57] ABSTRACT

The general purpose of the device described herein, the Smart Automatic Medication Dispenser, is to aid medical patients who must consume several types of medications several times a day for long periods of time. Often, due to daily diversions, it can be difficult for a patient to keep a running record of the amount of medications and the times at which they must be administered. The specific purpose of this computer controlled dispenser device is to provide a convenient vehicle and means by which properly proportioned medication doses are housed and automatically delivered to the patient in single complete doses. This user friendly and expandable dispenser will deliver medication in the proper chronological order and at the precisely correct/prescribed daily time intervals for a nominal period of one full week. Included in this device are comprehensive patient alerting capabilities, including familiar voices, all coordinated with medication delivery. Contained within the dispenser device is the ability to dial out and receive telephone messages to inform health care personnel of the dispenser's status, usage and to change internal dispenser programs.

25 Claims, 13 Drawing Sheets

SMART AUTOMATIC MEDICATION DISPENSER

This application is a continuation-in-part of U.S. application Ser. No. 08/407,203 filed Mar. 20, 1995 now abandoned.

BACKGROUND OF THE INVENTION

This invention relates generally to home-based health care, and more particularly to a fault tolerant, computer controlled medication dispensing system with a detachable medication magazine that is easily interchangeable, transportable, and refillable at a remote reloading facility.

It is often desirable to have an apparatus that administers medications automatically and monitors a patient's compliance with a medication regimen. Frequently home-bound solitary patients may be enrolled in rigorous medication programs with no daily supervision, or perhaps, only sparse supervision or visits on a weekly basis by a case worker or family member. Furthermore, they are often required to consume regular pre-scheduled doses of several types of medications, in tablet form or liquid form (cough medicine, antibiotics, nose, ear, and eye drops etc.) several times a day. The scheduling, record keeping and timing for the consumption of prescribed doses of medications of many types can be a taxing experience for most people, particularly for the elderly.

These problems have led to the development of a number of devices which attempt to solve the problems inherent in a home based medication dispensing system.

U.S. Pat. No. 4,748,600 to Urquhart is an interactive programmable dispenser that actively controls the pattern in which doses of one or more pharmaceutical preparations are administered to a patient. This device monitors deviations from a prescribed medication regimen and can calculate medication correction factors to bring a patient back onto schedule by analyzing some bodily fluids. But Urquhart's dispenser does not solve several needs: the need for a removable magazine for off-line reloading, transportation and storage of patient medications, the need to detect if the medication has been picked-up by the patient, and the need for a persistent as well as interactive patient alerting system. Also, Urquhart cannot handle liquid medications.

U.S. Pat. No. 4,872,591 to Konopka is a portable dispenser containing a plurality of medication canisters which are discharged from the built in magazine structure at the appropriate time. The canisters are ejected by means of a motor-driven feed slide mechanism containing cams, guide tracks and moving pistons. The dispenser also contains various alerting devices. But Konopka's delivery mechanism, accomplished mechanically with cams, levers, pawls, rods etc., does not solve the need for a simple, reliable and cost effective delivery mechanism accomplished with a single rotating ejection arm. Also in Konopka the individual medication canisters must be loaded directly into the unit and thus it does not solve the need for a portable magazine which may be loaded off-line at a pharmacy, at a visiting nurses headquarters, or at a family member's home. The ejection sequence in the Konopka Dispenser is such that it will always eject a medication canister at the dosing time and hence it also does not solve the problem of a non-responsive patient and the problem of canister accumulation or canister mix-up.

U.S. Pat. No. 5,047,948 to Turner is a programmable medication dispenser which automatically produces the patient's medication by rotating coils, each coil having medication packets hanging from the coil sections and being delivered into a receiving receptacle when the coil rotates. This dispenser can accept the patient's physical data and analyze the patient's condition as well as interact with the patient. In Turner an outside phone line is used for the patient to speak to health care workers during emergencies but it does not solve the need for a system to have frequent on-line instrument monitoring in the health care workers' headquarters and a phone connection to change the microprocessor's internal operating software as well as emergency medication delivery. Also the Turner Dispenser has a complicated and busy front panel which may cause patient confusion and impair performance and thus Turner's design points out the need for a simple front panel such as a single flashing push-button, a small visual display window showing the day-time-date and a small red Light Emitting Diode (LED) which will light-up in the case of malfunctions or danger.

U.S. Pat. No. 5,221,024 to Campbell is a programmable dispenser with manual over-ride. This dispenser has a single built-in vertical magazine with top loading and bottom dispensing of medication canisters. This dispenser has patient alerting features and color coded medication canisters. It provides medication in a sequential manner since the canisters are stored in a single stack. Campbell's dispenser is a single stack of medication canisters and as such it only delivers canisters in the stack sequence; therefore, if a dose is missed by the patient the entire sequence is out of proper delivery order. Thus a need still exists for a system that can deliver medications out of sequence, skipping any number of doses, if the patient does not respond to the alerting, and still not fatally violate the required delivery sequence.

In conclusion, there are medication dispensing aides which will alert a patient at a specific time to take a specific medication. However, in the case where a patient must take several different medications, say more than two or three types at various times throughout the day, there are currently no existing dispensers which are effective and comprehensive enough to fulfill the coordinated multi-tasking requirements of individual patient signaling/directing, external medication delivery, and regimen compliance/verification with a detachable medication magazine that is easily interchangeable, transportable, and refillable at a remote reloading facility.

The references cited supra show devices that are limited by the complexity of the delivery mechanisms, that do not have a detachable medication magazine that is easily interchangeable, transportable, and refillable at a remote reloading facility with a complex regiment of various tablet or liquid medications. They cannot track and record a multiplicity of medications due to be consumed according to a schedule at a multiplicity of daily times, even if the patient skips any dose. Nor can they provide computer controlled, comprehensive and persistent alerting capabilities including familiar human voice or verbal step-by-step instructions and direction to the ejected bottle location for collection. Nor can they provide variable volume and adaptable acoustic and optical signals with an automatic two-way, out of dwelling, external communications capability to alert the health care provider or family of its status and usage. Nor can they provide on line medication regiment changes and automatically keep a record of all medication deliveries for compliance purposes, even if they are delivered out of the scheduled order. Nor can they provide built in fault tolerance monitoring and self diagnostic warning indicator lights for warning the patient and the health care provider by telephone that something has gone wrong and to get outside help.

SUMMARY OF THE INVENTION

Accordingly, several objects and advantages of the invention are:

(a) to provide a convenient vehicle and user friendly means by which various tablet or liquid medications are stored and resourcefully dispensed in scheduled complete doses in the patient's own home;

(b) to provide an expandable modular dispenser having variable number of daily dispensing times and a multiple medication dispensing capability within any one dose;

(c) to provide fully automatic computer controlled, patient interactive medication dispensing means to track and record a multiplicity of medications due to be consumed according to a schedule at a multiplicity of daily times, even if the patient skips any dose;

(d) to provide computer controlled, comprehensive and persistent alerting capabilities including familiar human voice, variable volume and adaptable acoustic and optical signals for reminding the patient that it is time to take his/her medication;

(e) to provide remote wireless acoustic and optical alerting with alerting messages being printed out on a playing television;

(f) to provide a dispenser with an automatic two-way external, out of the patient's dwelling, communications capability which will alert the health care provider or family of its status and usage as well as being capable of on line medication regiment changes;

(g) to provide, at the push of a single clearly visible (patient activated) release button, automatic delivery of a single container or packet containing all medication required for that dose in a fixed, preset, clutter free location external to the dispenser and within easy patient reach;

(h) to provide a dispenser which has a detachable internal medication storage mechanism that is easily interchangeable, transportable, and refillable at a remote reloading facility;

(i) to provide a dispenser with automatic record keeping of all medication deliveries for compliance purposes, even if they are delivered out of the scheduled order;

(j) to provide a dispenser with a self diagnostic warning indicator light for warning the patient and the health care provider by telephone that something has gone wrong and to get outside help.

These and other objects are accomplished by this automatic medication dispenser, the Smart Automatic Medication Dispenser, as it provides a clear path to the medication canister by using indicator lights to direct the patient to the canister release button and by using verbal step-by-step directions to the canister location for collection. This dispensing apparatus comprises a dispenser main body having a transparent receiving bin, and a detachable medication magazine, detachable from the dispenser main body, the magazine having a plurality of stack structures (each dosing time requiring one stack), each stack structure having a plurality of stacked medication canisters within. All the stack structures taken as a whole comprise the said detachable magazine which is capable of holding a multi-day, prescribed sequence of medications, as a single transportable unit. An internal computer monitors and coordinates the time of the day, dose delivery times and generates alerting signals to a patient. This dispenser then directs the patient to itself and waits for an interactive signal from a patient activated push-button. On receiving this activation signal the internal computer sends an electrical ejection signal to a solenoid which in turn activates an ejection arm to push a selected medication containing canister from the medication magazine into the transparent receiving bin for collection by the patient. The solenoid in essence acts as a means to translate the electrical signal into a mechanical motion of the medication containing canister.

Other objects, advantages, and novel features of the invention will become apparent from the following detailed description of the invention when considered in conjunction with the accompanying drawings.

DESCRIPTION

Figure 1:
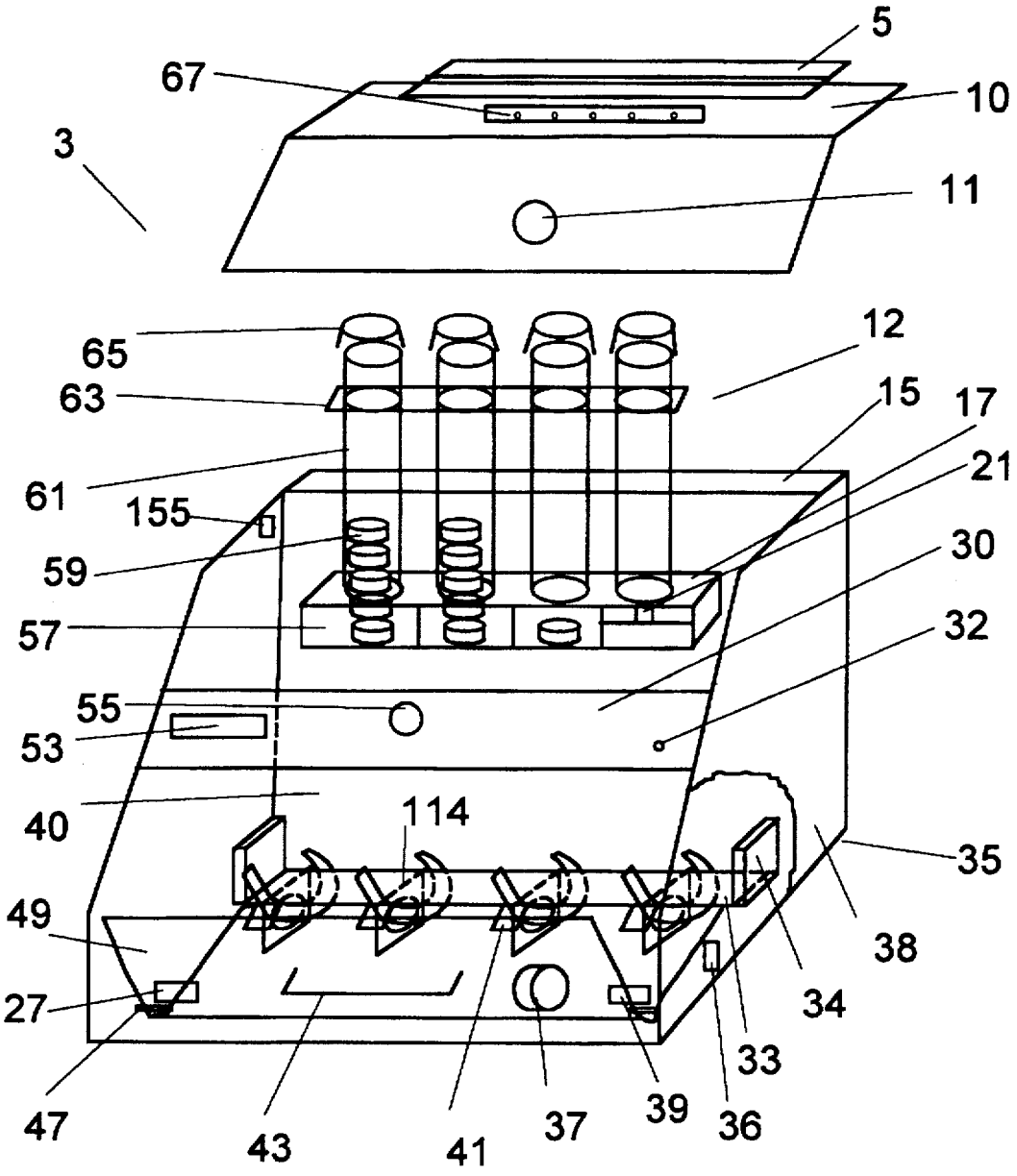
FIG. 1 is an expanded view of the a Smart Automatic Medication Dispenser.
Figure 2:
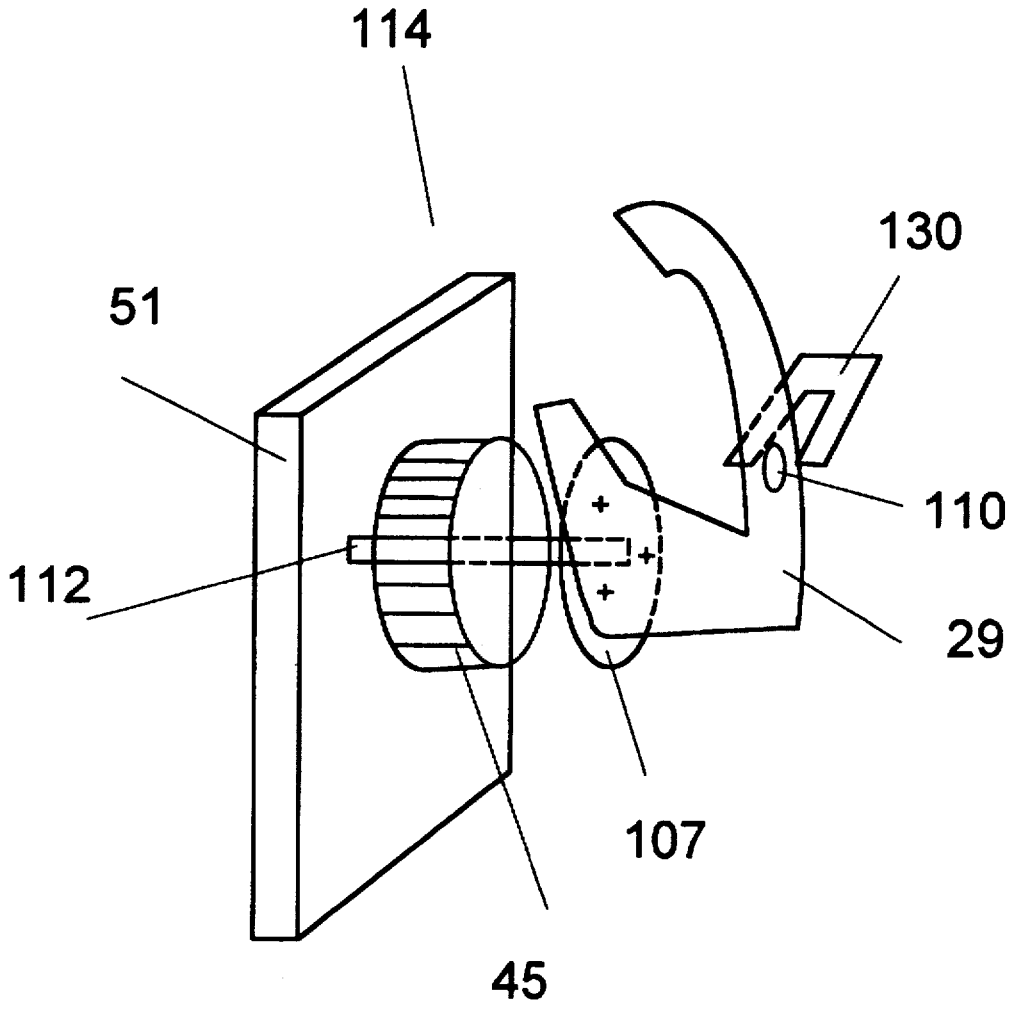
FIG. 2 is a pictorial view of the ejection mechanism assembly of the smart automatic medication dispenser shown in FIG. 1.
Figure 3:
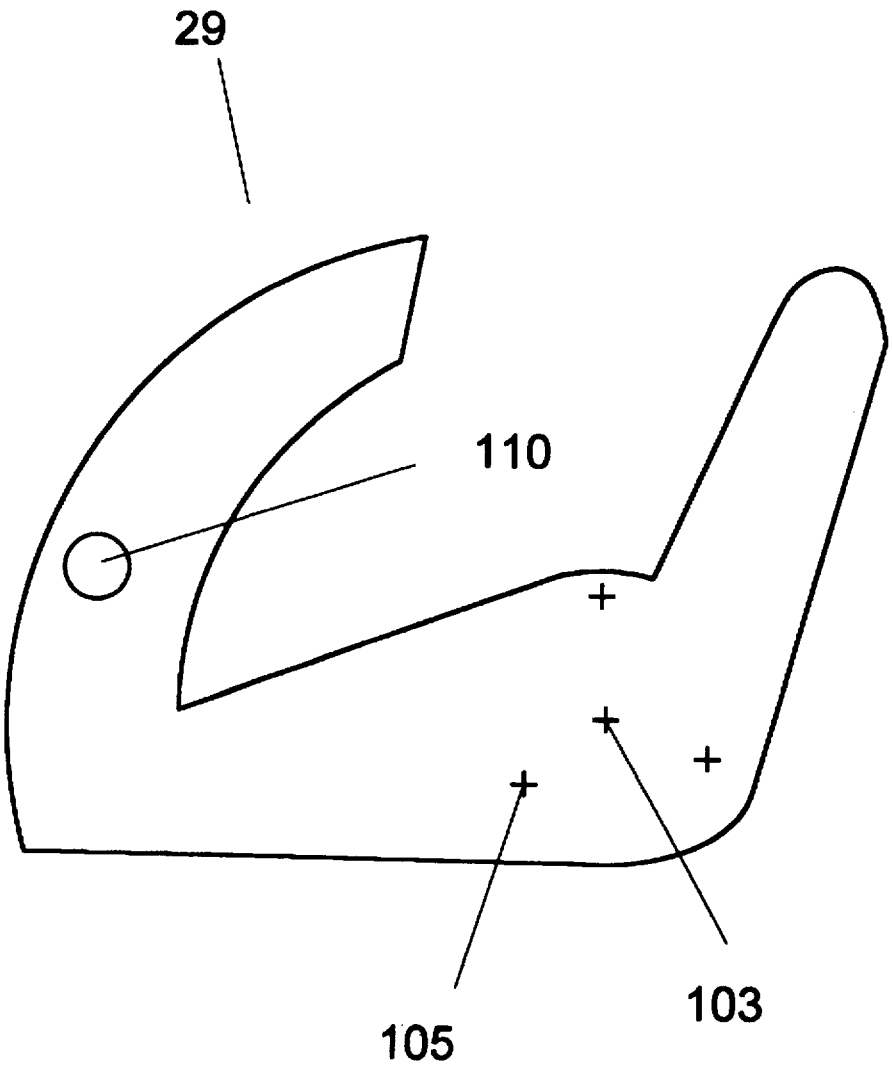
FIG. 3 is a detailed view of the ejection arm of FIG. 2.
Figure 4:
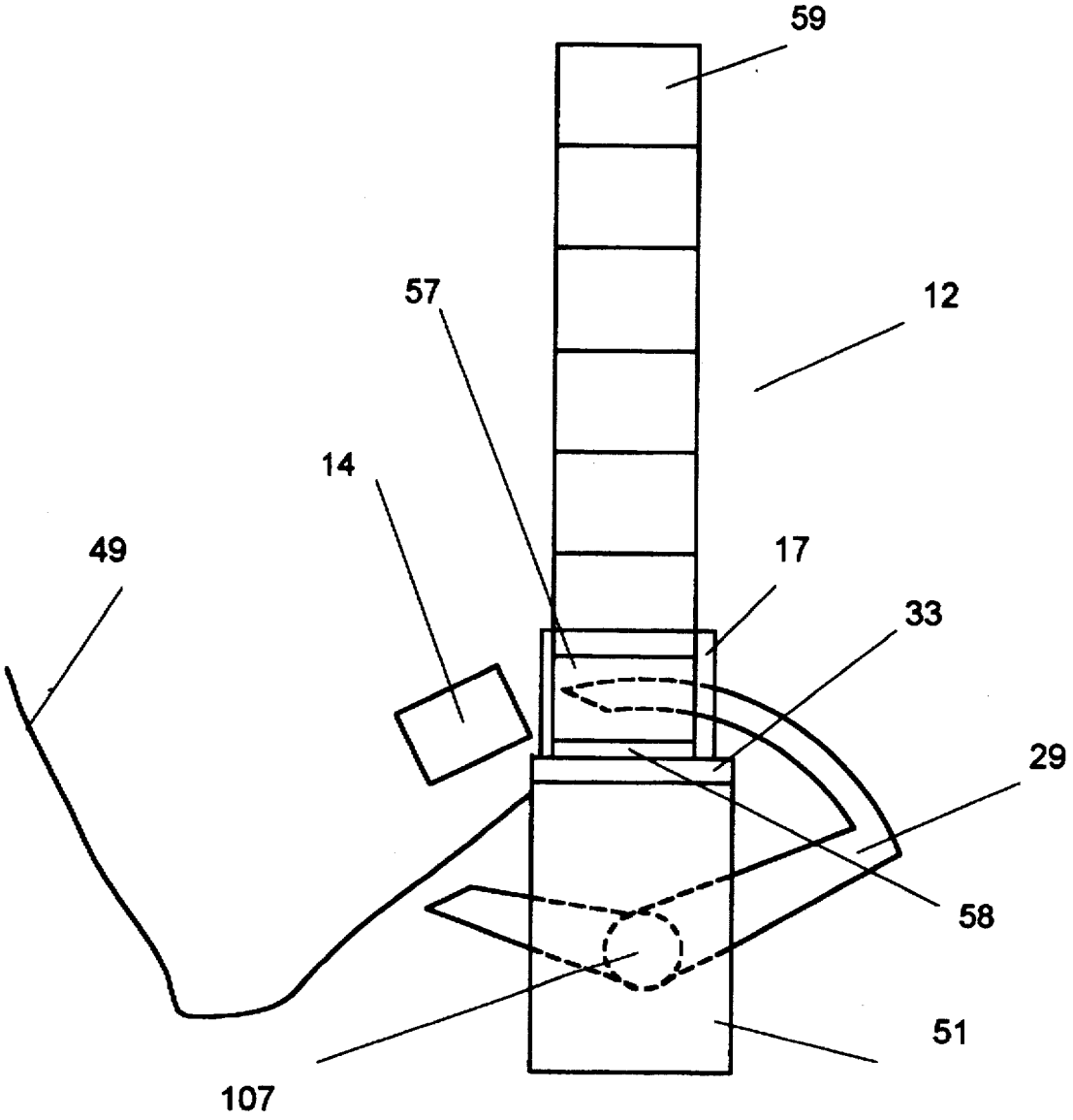
FIG. 4 is a side view of the smart automatic medication dispenser of FIG. 1 showing the arm executing the ejection stroke movement which moves the medication canister into the transparent receiver bin.

Referring now to the drawings, wherein like characters represent like or corresponding parts throughout the several views, one sees in FIG. 1 of the smart automatic medication dispenser 3. The dispenser delivers individual cylindrical canisters (approximately 1.25" high by 1.25" in diameter) containing all of the medication needed at the time delivered. FIG. 1 shows the dispenser main body or housing having a hinged 5 top cover 10 with lock 11, side walls 38, a front panel 30, and a bottom wall 35. The front panel 30 is a structural cross member (e.g., 0.100" thick aluminum plate with plastic facade) screwed to the side walls and contains a Liquid Crystal Display (LCD) 53 (approximately 3" long by 0.6" wide located in the upper left corner as viewed) which will electronically show day of the week, time of day, and date. The front panel 30 also contains a red (danger get help) indicating Light Emitting Diode (LED) 32 (located in the lower right corner as viewed) and a large self illuminated push button switch 55 (located in the center of the panel) which flashes simultaneously with the top array of LEDs 67 at the correct dosing time and when depressed by the patient will cause the appropriate medication canister to be ejected. The external back and side walls are attached and mounted on the bottom wall 35 as are four, internal vertically oriented, (0.25" thick) aluminum stanchions 51 (FIG. 2), which serve as the support structures for the rotary solenoids 45. The rotary solenoids 45 are attached to the stanchions 51, shown in FIG. 2, with screws and lock washers. FIG. 2 also shows the ejection mechanism assembly 114 comprised of the stanchion 51, the rotary solenoid 45, the rotating shaft 112 and solenoid face plate 107 as well as the attached ejector arm 29. FIG. 1 shows how the ejection mechanism assembly 114 is situated in the overall dispenser. The rotary solenoids have a vertically oriented ejector arm like structure 29 screwed onto the rotating face plate 107 of the solenoids. The shape of the arm structure 29 is shown in detail in FIG. 3 which shows the center of rotation 103, the screw mounting holes 105 and the arm movement sensor hole 110. A key point in the design of the arm structure is the arc like section of the arm which does not have a constant radius on the outer arc but rather is shaped like a cam or wedge (being flatter near the point) on the front portion of the arm so as to permit easier retraction under the weight of the canister stack after the ejection stroke. Referring now to FIG. 4, when a solenoid activates, at the correct dosing time, the face plate 107 and attached arm 29 rotate approximately 45 degrees into the magazine bottom block 17 to push the bottom canister 14 out of each canister stack 59. FIG. 4 also shows the process of canister 14 ejection into the canister receiving bin 49. On the top side of the stanchions 51 a horizontal metal plate 33, approximately 0.100" in thickness, having the same depth as the stanchions, is attached with screws. The horizontal plate serves as the platform support structure which bears the weight of the portable medication magazine assembly 12.

FIG. 1 also shows the medication transport magazine 12 which is fabricated from plastic tubing 61, e.g. acrylic tubing, cut into lengths long enough to stack the medication canisters 59 one on top of the other so as to store enough canisters for a week or more. In production the magazine may be molded as a single structure. The magazine nominally consists of 4 tubes, however, more tubes can be added as needed since the solenoid and the tubes are parallel and operate independently. The tubes are capped 65 at the top end and are held together at the top by a rigid plastic fixture 63 and at the bottom by the magazine bottom block 17. The magazine bottom block forms the insertion end of the magazine assembly as it is joined to the dispenser body at the horizontal plate 33. The magazine bottom block supports the medication storage tubes and forms canister chambers 57 at the bottom of, and within, the magazine assembly where the canisters are kept separate and await ejection. The rear of each chamber has a vertical slot 21 cut into the rear wall to permit the ejection arm to pass through the bottom block and to impact the bottom canister for ejection. The magazine also has a floor member 58 (FIG. 4), of 0.100" thick acrylic or 0.06" thick aluminum plate, attached to the bottom end of the bottom block 17. Furthermore, mounted on both sides of the horizontal plate next to, and attached to, the outer walls are acrylic fixtures 34 (FIG. 1) attached to the outer walls which serve as side support to stabilize and hold the magazine assembly 12 (FIG. 1) when mounted in the present invention dispenser. The entire magazine assembly is portable and may easily be inserted into, or removed from, the cavity formed by the horizontal plate and the side support structures. Referring to FIG. 4, the ejector arm 29 moves on a path which is above the horizontal plate and the magazine floor, through the slots in the rear of the bottom block to strike the bottom canister and push it out into the receiving bin 49. Also shown in FIG. 1 are slots 41 cut into the receiving bin 49 which allow the front part of the ejection arm to pass through the bin and out of the ejecting canister's path. Another important feature built into the magazine structure is the automatic electronic patient identification code located near the bottom of the bottom block. To avoid possible magazine/patient mismatch, each portable magazine will have a electronic identification code attached to it so that, upon insertion into the present invention dispenser, it will be automatically recognized as the proper medication magazine for the patient intended.

The one piece plastic (acrylic or PVC) of top cover 10 in FIG. 1 contains a bend made by heating the cover and forming it to contour along the along the top and down the front side. The top cover is attached to the dispenser by a piano hinge 5 and is provided with a keyed lock 11 to prevent patient or unauthorized entry. By lifting the top cover the magazine may easily be inserted between support plates 34 to rest on the plate 33.

Referring again to FIG. 3 the rotating ejector arm 29, when mounted onto the solenoid rotator plate via holes 105, has a straight vertical section protruding upward in front of the bottom canister of the magazine. In addition, the rear section of the arm is an arc like section which, upon solenoid activation, impacts the canister from the rear, as shown in FIG. 4, as it moves through slots in the bottom block 17. When in the rest position, the near vertical straight part of the arm 29 is designed to protrude about 0.6" above the bottom block floor member, and in front, of the horizontal plate 33 to prevent the bottom canister from sliding forward before ejection time. The entire ejector arm is cut out of a single metal plate, approximately 0.100" in thickness, so that when the solenoid is activated the front near vertical straight arm section also rotates downward, through the bin slots 41 (FIG. 1), and away from the front chamber 57 canister exit opening of the magazine allowing the canister to exit the magazine as the arc like arm section impacts the canister 14. After impact and ejection the arm returns to its rest position as shown in FIG. 2. FIG. 2 shows a small hole 110 drilled along the top part of the arm arc section to serve as a marker through which light will pass (or be blocked) to activate (or deactivate) the optical sensor 130 which then detects the movement of the arm. By timing the light pulses which pass through the hole in the arm the microprocessor can track the movement of the arm along its stroke and relaxation movement. Thus arm movement sensors can detect and monitor the arm stroke and return movement. If the movement is not according to design the sensor information causes the microprocessor to activate the red panel mounted get help LED 32, shown in FIG. 1, and the voice warning to get help.

As seen in FIG. 4, as the arm rotates a canister 14 is ejected into the receiving bin 49 which is located in the lower front section of the dispenser. The receiving bin 49 has one side which forms part of the outside front section of the dispenser. The interior side of the receiving bin is in contact with the front of the stanchions 51 and has 4 slots 41 cut vertically into the interior side. The slots allow the vertical section of the ejector arm to rotate freely past the interior bin wall as the arm strokes 29 forward and ejects a medication canister. The canister falls into the "V" shaped receiving bin and rolls or slides toward the lowest point near the front awaiting pick-up by the patient. FIG. 1 shows a resting canister 37 awaiting patient pick-up in the bin. The patient simply pulls the receiving bin out by the handle 43 located in the front of the bin and reaches in to collect the medication canister. The bin is attached to the dispenser body by pins 47, seen in FIG. 1, located at the corners of the bin. The lowest point in the receiving bin is equipped with a canister detecting sensor. The optical canister detecting sensor is comprised of two parts: an optical sensor 27 and an optical transmitter 39. The sensor 27 is located on one side corner of the bin and the optical transmitter 39 is located on the opposite corner. The optical transmitter projects a narrow optical infra-red beam across the lowest part of the bin which is obstructed by the canister if it is present. If the beam is obstructed the micro-processor will instruct the voice chip to verbally warn the patient that they must pick-up the canister now. If the patient does not pick-up the medication canister after a programmed amount of time the red get help LED 32 in the front panel will blink and a help needed phone message is automatically sent out to the health care worker or a family member by the microprocessor. Moreover, if the receiving bin 49 is not closed properly by the patient after the medication canister 37 is picked-up an internal microswitch 36 will sense the ill-placed bin and, subsequently, verbally alert the patient instructing him/her to "close the bin." Furthermore, there is an electrical switch 155 which will sense that the top cover is not properly shut and the switch 155 will also insure that the top cover is secured by providing a warning.

Another feature of this dispenser is a small conventional video camera approximately 2.5"×2.5"×3.5" which can be mounted externally on top of the dispenser to observe that the patient is actually consuming the medication. It is anticipated that some patients will be troublesome and require extra monitoring by the family or health care provider to ensure the proper medication compliance. It is in these cases that the video camera will be attached to the top of the dispenser above the LED array 67 (FIG. 1) for direct patient viewing and monitoring. The video camera will have a low data transfer rate or bandwidth so that it may be transmitted through the RS-232 interface via a common telephone line. To implement the video information and transfer capability, this dispenser will use conventional data compression and transmission methods. If required the family or health care provider will have ability to directly observe the compliance habits of the patient.

Referring to FIG. 1, immediately behind the magazine is an internal dividing wall 40 which together with the back external wall and part of the external side walls form the internal electronics compartment 15. The electronics compartment is isolated and generally inaccessible. Mounted in this compartment is a power supply to provide +5 volts direct current (DC), +12 volts DC and +24 volts DC. Also located in this compartment will be the microprocessor and surrounding circuitry shown in FIG. 6 and FIG. 8, a speaker to deliver human voice messages 240 (FIG. 6), a wireless radio frequency generator to provide remote alerting 225, a battery back-up capability as well as the telephone interfacing components 235. An important feature of the present invention dispenser is the ability to communicate outside the patient's dwelling using the conventional telephone lines. The telephone interface modem 235 (FIG. 6) has the ability to perform two way phone communications to and from the present invention dispenser; thus using the phone line, instructions may be given to the present invention dispenser over the phone line at any time. Also using the phone, the present invention dispenser can provide patient medication compliance information to family or health care providers at any time. Most of the electrical power and all of the high voltage is contained in this compartment 15 as well as all input and output connectors. Referring back to FIG. 1, the present invention dispenser will also have optical flashing lights built onto the top 67 of the unit as well as a wireless remote optical flashing capability and a single flashing push button 55 on the front panel 30. It will be completely coordinated in all of its functions by a microprocessor 215 (FIG. 6) to alert the patient calling the patient by name in familiar voice, step-by-step verbal instructions to urge the correct response in taking their medication. It will also have acoustic alarms including a wireless remote acoustic alarm (buzzers, beepers, etc.) and voice messages. Another alerting feature is the ability of the present invention dispenser to interrupt, via radio frequency link, a receiver attached to the operating television to screen display and voice the message that it is time to take their medication. Side handles for lifting and rubber anti skid pads are placed on the outside of the bottom wall to secure the dispenser on a table or countertop.

Figure 6:
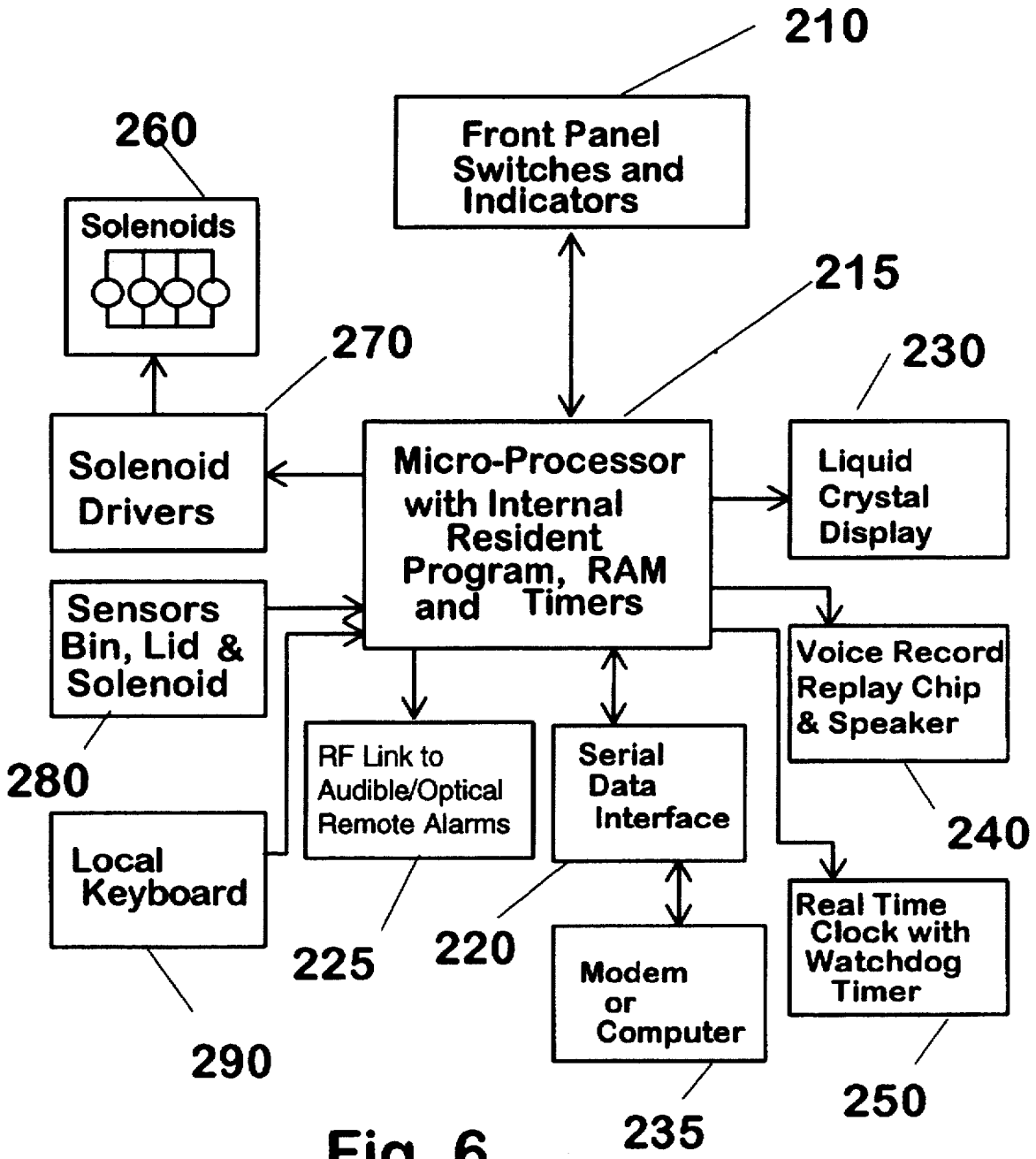
FIG. 6 is an electronic block diagram of the smart automatic medication dispenser.

In operation the present invention dispenser's conventional computer 215 (FIG. 6) will autonomously keep a continuous time record and coordinate all timing and dispensing functions automatically. The time will be constantly displayed along with the patient's name, date, and day of the week on the front panel display 53 shown in FIG. 1 (electrically see 230 FIG. 6). The signaling operation of the present invention dispenser begins at the correct dosing times, as indicated by the internal clock and shown on the clock display on the front panel 53 shown in FIG. 1, with the acoustic and optical alerting functions. These alerting signals will remind the patient, with alarms and by voice, that it is time to take his/her medication. In addition to the indicator lights blinking in clear view on the present invention dispenser, there are acoustic signals and remotely positioned wireless alarming devices in the patient's dwelling that are initiated to alert the patient when the dispenser is not in sight 225 (FIG. 6). There is a beeping sound and a human voice 240 (FIG. 6) that utters the reminder "It is time to take your medication." The volume of these acoustic beeping signals will be varied starting softly at first but increasing automatically in volume every 5 minutes.

Contained within the present invention dispenser is a commercially available central computer chip 215 and electronics package seen in FIG. 6, located around the internal electrical compartment 15 of FIG. 1, that keeps a continuous record of elapsed time and controls exactly which indicator light and acoustic alarm is activated. The computer maintains a compliance indicator counter 250 (FIG. 8) which is a record of the total number of times a canister is removed when the patient activated bottle release button 55 (FIG. 1) is pushed.

On the front panel of the present invention dispenser is located a patient name plate for positive identification. Also there is a power switch located remotely to turn the dispenser on and off and a key board to select, on location, the dosing times required. All control switches which are set only once using the key board 290 (FIG. 6) will be located in concealed tamper resistant positions within the housing. Also in the electrical compartment is located a back-up battery system. On the front panel 30 of FIG. 1 is located a red LED indicator light 32 which will serve as a danger indicator signal. Each red warning light or LED will turn-on if the present invention dispenser malfunctions or jams, if there is a power failure, if the dispenser is turned off, or if any irregularity occurs. Additionally the liquid crystal display (LCD) on the front panel is programmed to display the basic instructions and a phone number to call for help if the red danger light goes on. Also contained in the present invention dispenser is an automatic external communications capability 235 (FIG. 6) either through the domestic telephone or some other communications network like the internet etc. The two-way telephone interface modem is connected to this dispenser through the RS-232 interface 220 (FIG. 6) which is located in the electronics compartment. In addition to the modem calling out for help or instruction, health care workers or a family member may call into the modem of the present invention dispenser at any time to check on its status and usage rate or to change any scheduling or programs previously placed in the dispenser.

The row and column configuration of the magazine assembly helps to organize the way in which the unit operates. Each column or stack 59 (FIG. 1) of canisters represents one daily dose during the day. Each row of canisters across the stacks represents the day at which the medication doses must be administered. For example, the nominal four column configuration would be the medication doses required at breakfast, lunch, dinner, and bedtime. Furthermore, if additional daily doses are required then one may procure additional supplemental add-on column modules to attach to the standard 4 column magazine assembly 12 shown in FIG. 1.

The present invention dispenser is initially set up by someone familiar with the medication requirements of the prospective patient, perhaps a case worker, weekly visiting nurse, family member, or drug technician. Normally the present invention dispenser is setup for, at least, the entire week although longer periods are easily accommodated. For example, the case worker would select the prescribed medication mixture for the breakfast dose and place those tablets in the breakfast bottles located in the first (left most stack behind the liquid crystal display) column. Next, the medication mixture is selected for the lunch dose and placed in the lunch bottles located in the second column. Next, the dinner medication mixture is selected and placed in the dinner bottles located in the third column. Finally, the bedtime dose is placed within the fourth column. Each canister or bottle used in the stacks is a plastic bottle (approximately 1.25" in diameter and 1.25" high) with the cap having the same outer diameter as the bottle to facilitate the movement of the bottle down the stack. The cap has sides that have the same outside diameter as the bottle itself so as to form a smooth outer cylindrical surface over the entire height of the bottle.

The smart automatic medication dispenser must be loaded with medications in the correct proportions and dosing times as set by the case worker or a family member. For example, a possible timing sequence may be: the time interval for the breakfast dose could be between 8:30 AM and 9:00 AM, for the lunch dose between 1:30 PM and 2:00 PM, and for the dinner dose between 6:00 PM and 7:00 PM. All programs will be preset at the factory to default values providing roughly equal time intervals throughout the daylight hours. The actual number of hours between doses will, of course, depend on the number of doses, defined by the number of stacks as seen in FIG. 1. The present invention will be electrically powered by both 120 volts standard house service and by standard back-up battery cells. Under normal every day operation the house voltage will be used to conserve the batteries, but at any time the present invention dispenser may be disconnected to run on battery power for completely autonomous operation. Still other versions will be constructed to operate only on battery power for complete freedom of location anywhere in the patient's dwelling. On the underside of the present invention dispenser will be rubber button like feet to provide a stable placement on a table top.

The object of the present invention dispenser is to deliver the medication canister to the collection chamber 49 seen in FIG. 1. The patient activated release button 55 of FIG. 1 is not energized until the alerting period begins with beepers and lights, thus denying access to all medications except for those doses delivered. The bottom most bottle in the magazine assembly will be ejected. Only during the alerting period, at the push of the release button 55, one rotary solenoid 45 (FIG. 4) is activated and causes the ejector arm 29 to move into the magazine assembly and push out the bottom most bottle, moving it toward the collection bin 49. The collection bin is easily opened by the patient using the handle 43 to reach in and collect the bottle 37.

Referring now to the computer program flow charts of the smart automatic medication dispenser seen in FIG. 7(*a*)–(*g*), the programmed delivery sequence is shown. Assume that all times and alarms have been initialized as in FIG. 7*a* and times updated as in FIG. 7*e*.

1—At the correct dosing time shown on the display 230 (FIG. 6), the main program commences making various decisions (as shown in FIG. 7(*b*)) in the micro-processor 215 (FIG. 6). Various dispenser alarms are tested and set-off if needed as in FIG. 7*c* the acoustic signaling (including human voice 240 (FIG. 6)) and the blinking of an out-of-room table light or voice command are commenced 225 (FIG. 6). The remote blinking is initiated by a radio frequency link or an extended wire to the lamp. Also, the sensors are checked for discrepancies 280 (FIG. 6).

Figure 7A:
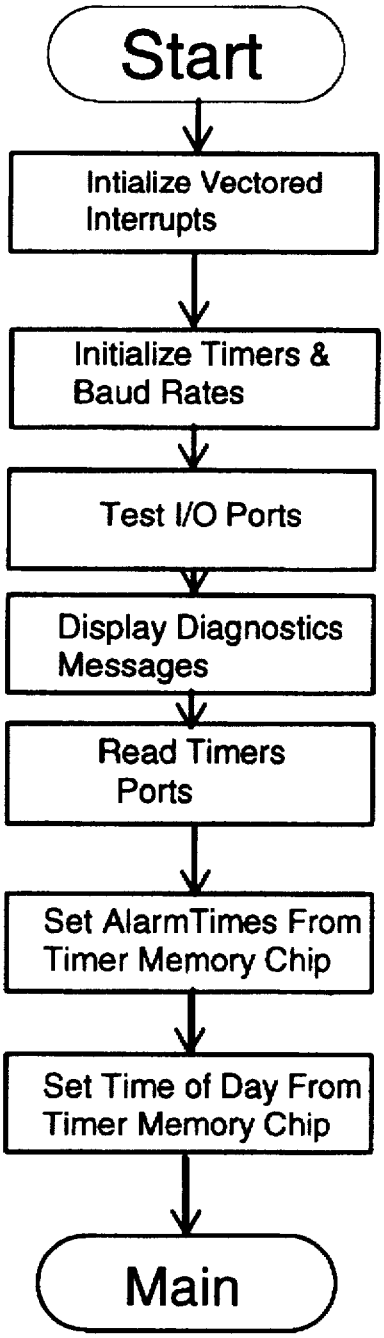
FIG. 7(*a*)–(*g*) are the computer program flow charts of the smart automatic medication dispenser.
Figure 7B:
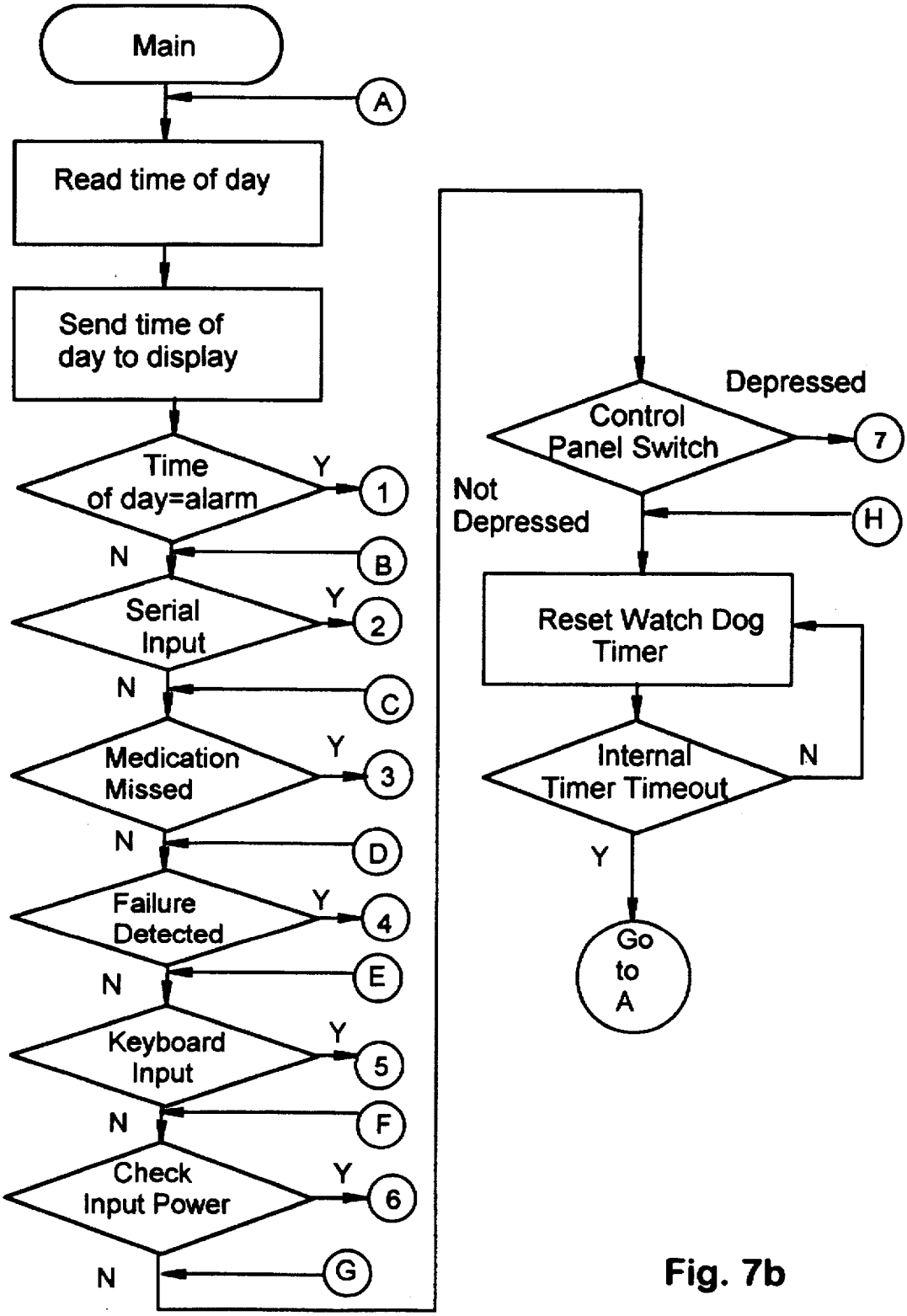
Figure 7C:
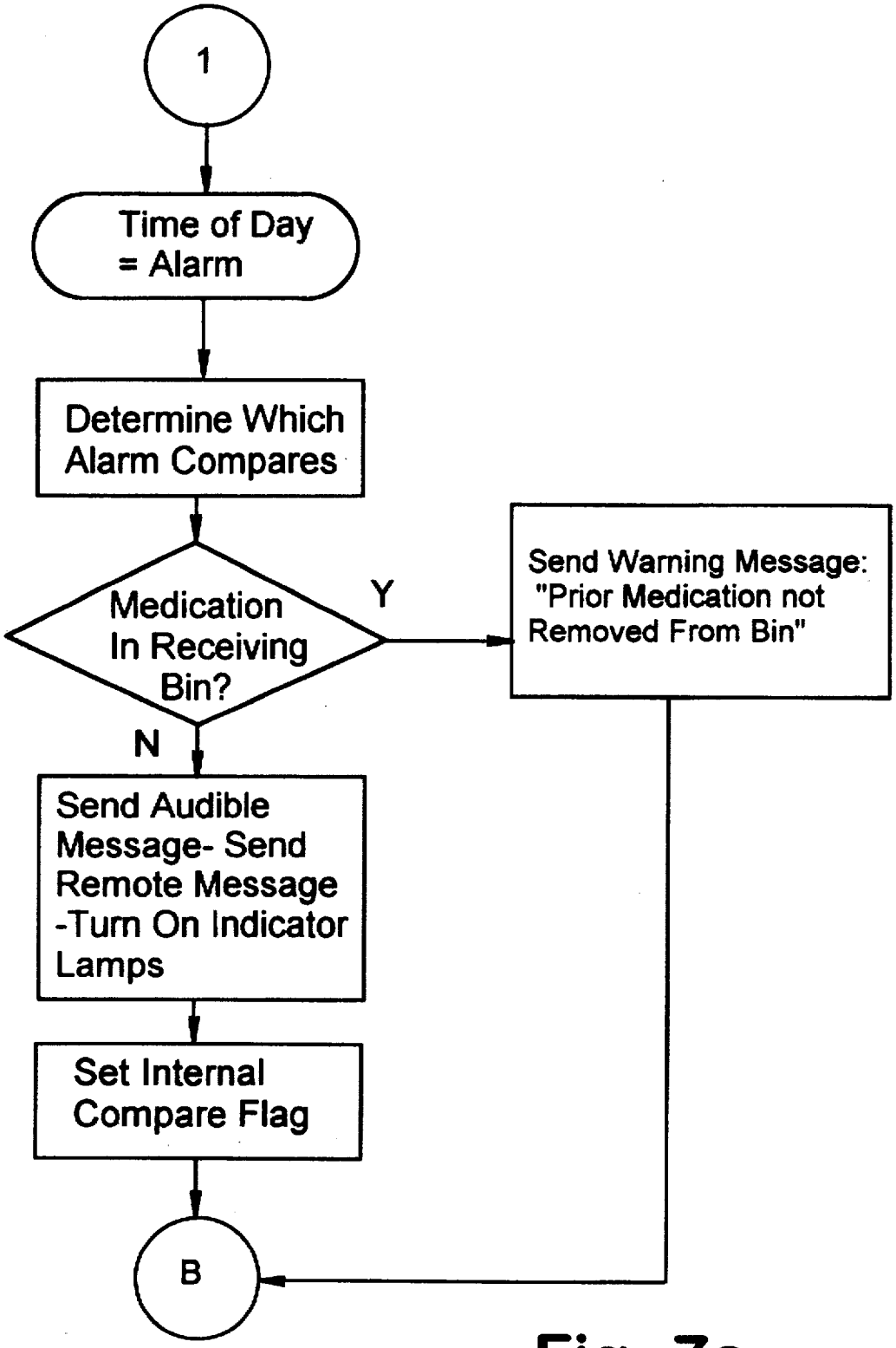
Figure 7D:
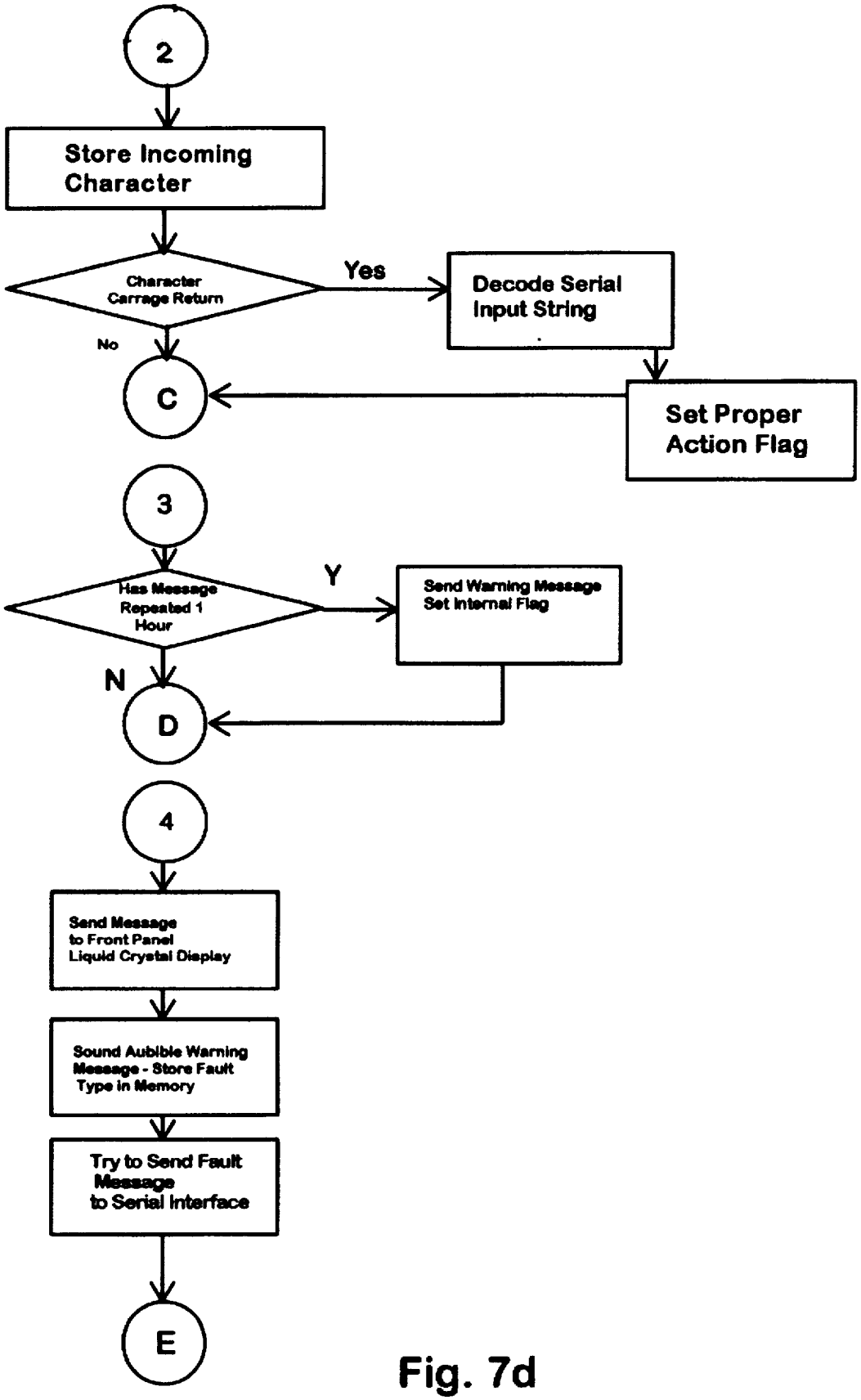
Figure 7E:
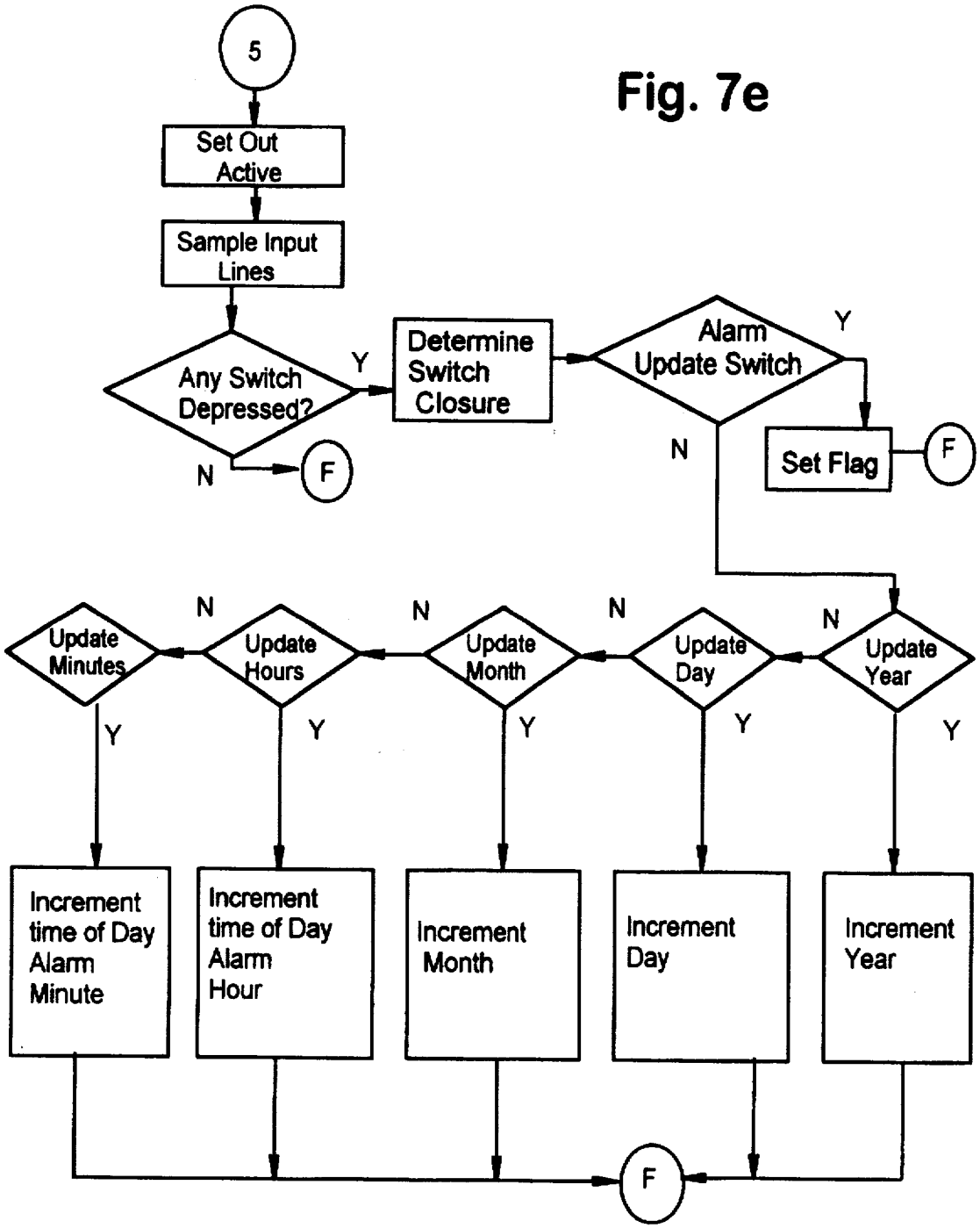

2—If the sound is ignored by the patient then the sound will repeat every minute up to a programmed interval, say, 30–60 minutes with increases in volume every 5 minute time interval as in FIG. 7*d*.

Figure 7F:
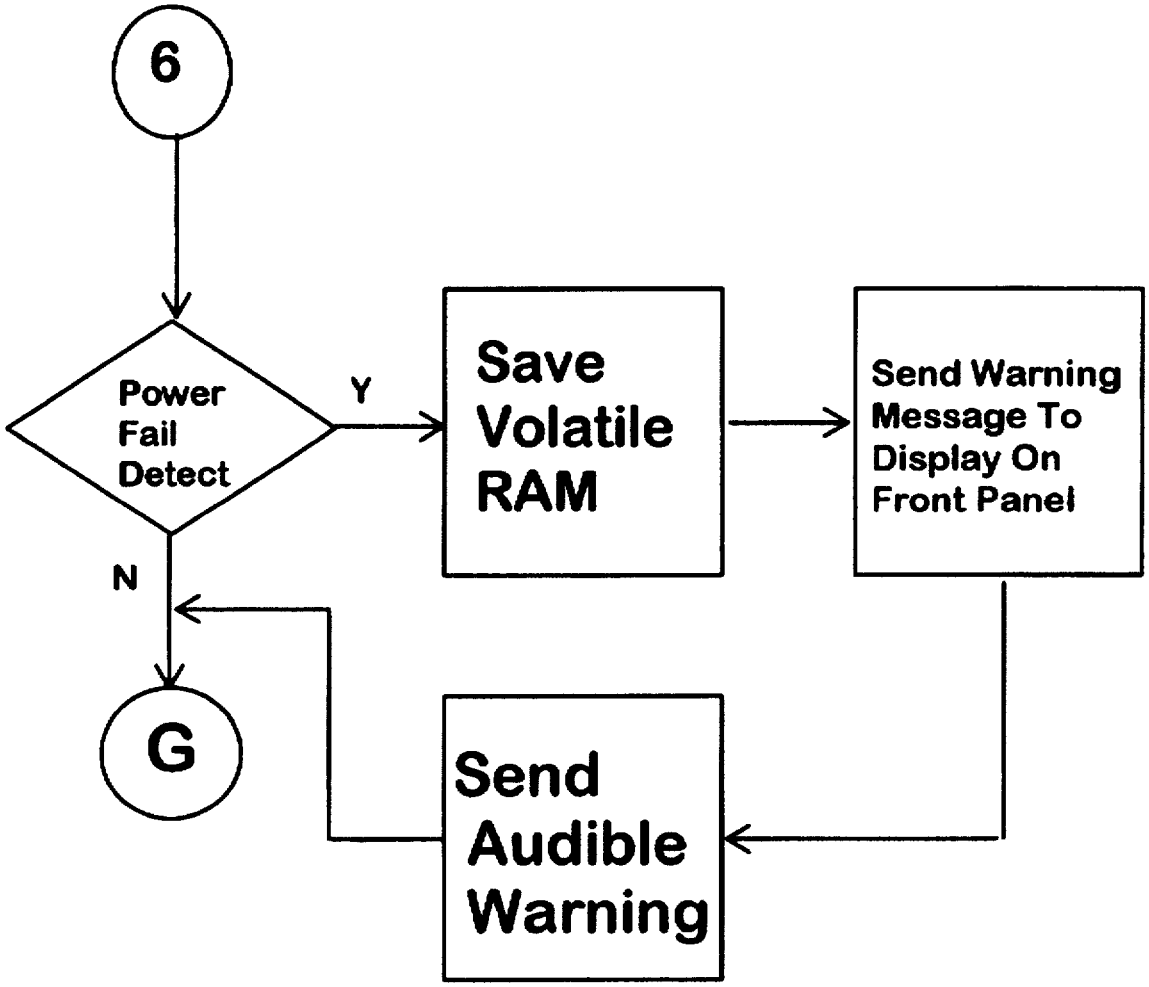
Figure 7G:
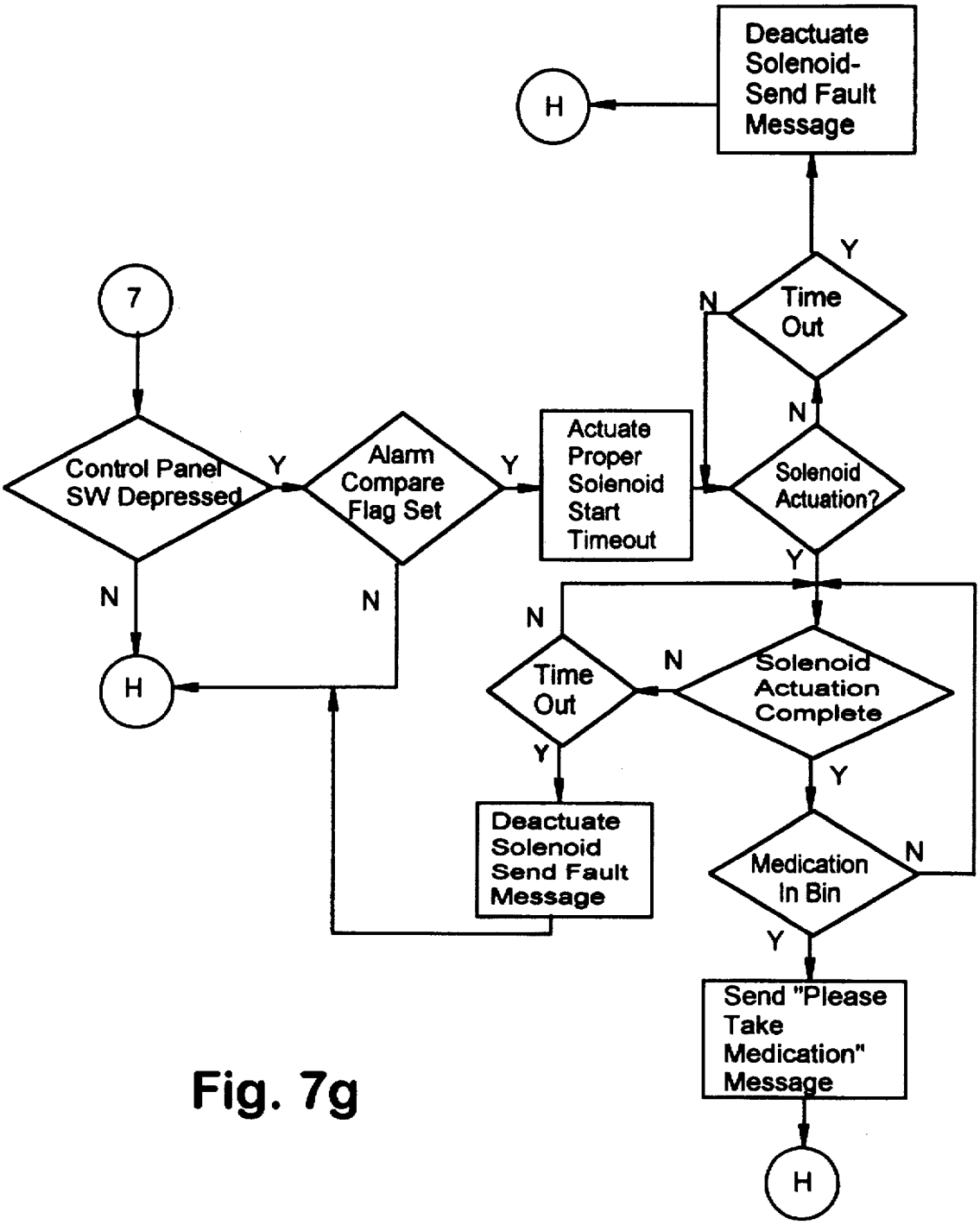

3—Simultaneously, the top array of LEDs is flashing as well as the illuminated medication release button 55 (FIG. 1); the medication release button and solenoid drivers 270 (FIG. 6) are activated and ready for use as in FIG. 7*g*.

4—When the patient pushes on the release button 55 (FIG. 1) to start the delivery ejection mechanism assembly 114 (FIG. 2) operating, the medication bottle is pushed out by the solenoids 260 (FIG. 6) into the collection bin 49 (FIG. 1) to await patient pick-up 37.

5—After the medication release button is pushed verbal instruction commences 240 (FIG. 6) for bottle pick-up.

6—Acoustic and visual signaling are terminated.

7—The compliance memory recorder, the Watch Dog Timer 250 (FIG. 6), located in the electrical compartment is incremented as in FIG. 7*f*.

8—The patient activated release button 210 (FIG. 6) is de-energized and the cycle is restarted for the next delivery time.

9—The collection bin is checked by a bottle sensor 27, shown in FIG. 1 and electrically in the block diagram 280 (FIG. 6), in that area to determine if the bottle has been picked up. If there is still a bottle remaining in the collection chamber then the acoustic, voice and optical alarms continue urging the patient to collect the bottle as in FIG. 7*c*. If the patient does not collect the bottle after one hour the health care worker or family member can be alerted, as in FIG. 7*d*, through the RS-232 telephone modem 235 (FIG. 6).

10—Also contained in this dispenser is a small video camera to observe the patient consuming the medication; the video camera would be used for troublesome patients needing the extra monitoring.

Once the present invention dispenser is set for service it will typically operate autonomously for one week or more. Its function is specifically accomplished by visually and acoustically alerting the patient at a precise time and precise location of a prescribed medication mix for immediate consumption. The acoustic signals will be both a low level beeper and a voice announcement. After the medication is ejected another voiced message will offer positive reinforcing feedback by saying "thank you, take all of your medication now." The internal computer will accomplish the timing task by electronically keeping a continuous record of the elapsed time. At the correct time interval for consumption the present invention dispenser will acoustically signal the patient while simultaneously directing the patient to the medication mix, by voice command, in the collection bin of the present invention dispenser. The patient will collect the indicated bottle and consume the entire contents. If the ejected bottle is not collected at the proper time by the patient there is a danger that the bottle may be left in the collection chamber 49 (FIG. 1) and several bottles may even accumulate causing patient confusion about which bottle to collect. To prevent this situation two courses of action are taken: first the sensor located in the collection chamber will sense that the bottle has not been picked up by the patient and the alerting signals will not stop urging the patient to pick up the bottle. Secondly, as an added safety feature, the present invention dispenser will not deliver the next bottle until the previously delivered bottle has been picked up.

In addition, located in clear view on the present invention dispenser body is a warning or danger indicator light. This warning indicator light 32, shown in FIG. 1, will alert the patient as to certain problems which may develop during operation. For example, the warning light may flash on if a power failure occurs, or if the internal circuits fail, or if there is a bottle jam, or if the patient is not using the present invention dispenser properly, etc. If the warning light is activated phone contact will be established to alert the health care worker.

Figure 8:
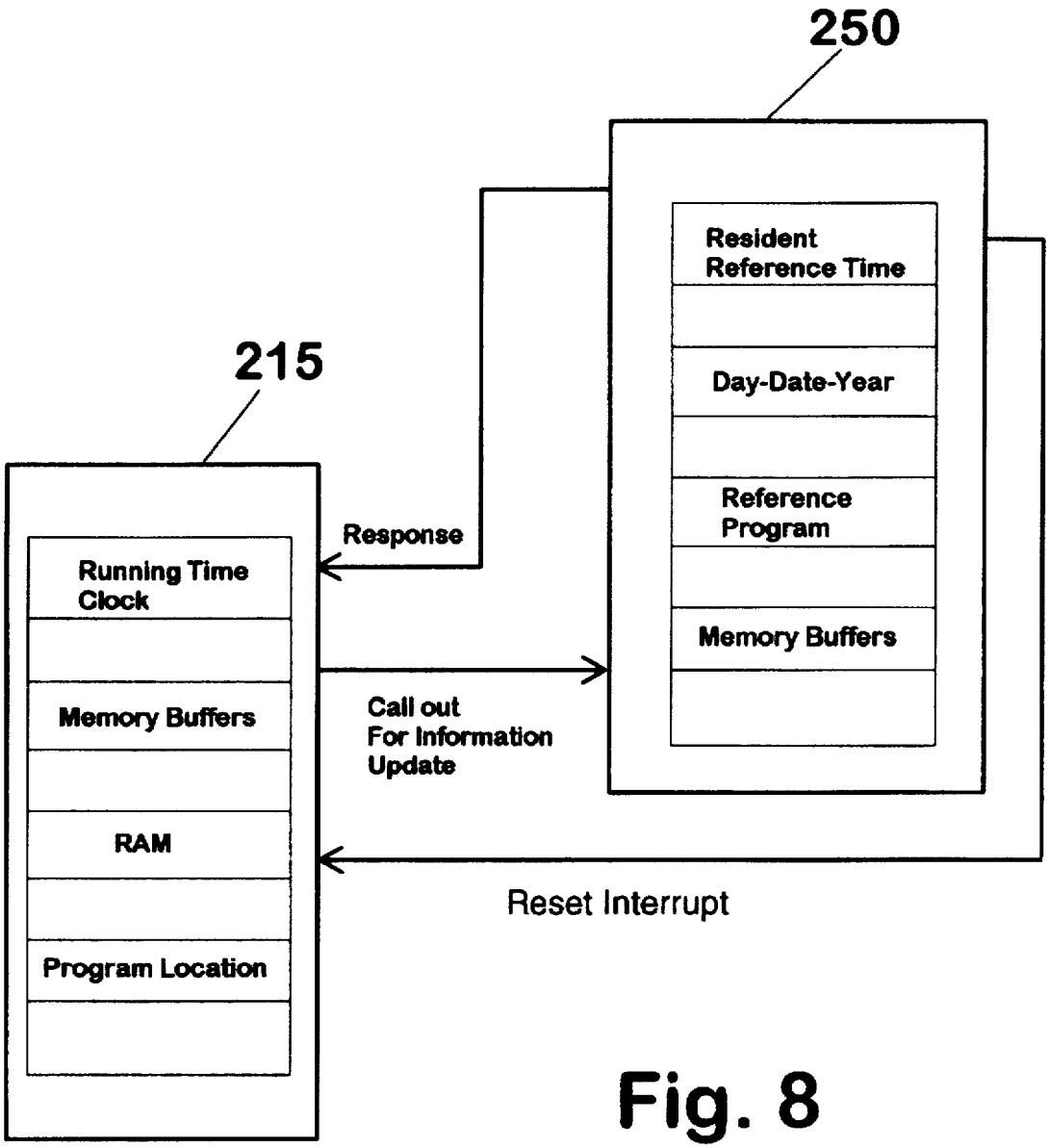
FIG. 8 is an expanded view of the micro-processor and real time clock with watch-dog timer of FIG. 6.

The present invention dispenser has, within the housing, conventional computerized timing and control circuits to perform the various timing and signaling functions. FIG. 6 shows the overall electronic block diagram and the soft-ware flowchart is shown in FIG. *7a–7g*. The face will show a digital clock indicating the time of day, the date, and the specific day by name. This device will have independent, redundant, and fault tolerant circuits so that they may check each other's performance for added reliability. If the two independent circuits do not agree the ultra stable reference chip (i.e. the Real Time Clock with Watch Dog Timer) 250 having the internal battery will prevail and update all the information in the micro-processor 215 as shown in FIG. 8.

The micro-processor 215 is the central coordinator of all electronic peripheral functions as shown in FIG. 6. The real time clock with WatchDog Timer 250 (FIG. 8) is a chip which is the keeper of a very accurate time base reference which refreshes or updates the micro-processor 215 (FIG. 8) running time clock. Furthermore, the Watch Dog Timer portion automatically generates a reset interrupt signal to the microprocessor in the event the program goes awry. It also keeps track of all important program information and inputs; it has a built in calendar, an internal battery as well as nonvolatile memory to protect all stored programs, information and program input parameters from loss due to power failure or other harsh operating factors. Because the Real Time clock with Watch Dog Timer 250 (FIG. 8) has a self contained nonvolatile memory with a self contained precision time reference it is ultra reliable and an efficient way to up-date the micro-processor timebase and to refresh the micro-processor's resident program to increase overall reliability and fault tolerance. Even if the micro-processor program is inadvertently locked up or loses the entire contents of its memory it is automatically restored and refreshed (see paths in FIG. 8). Thus the combination of micro-processor, Real Time clock with watch-dog timer is a very fault tolerant design which is important for medical applications not here-to-fore observed in this type of system. The Real Time Clock contains nonvolatile RAM so dispenser alarm times, statistics, the patient's medication usage information and compliance records are stored there. To guard against failure, the micro-processor is refreshed by the Watch-Dog Timer once per second to continuously update the time out counters and other needed dispenser information.

The liquid crystal display 210 (FIG. 6) on the front panel will show the day, the daily time and the date. The daily time, day-date-year and all dosing time alarms are set according to the patient's needs using the local keyboard 290 (FIG. 6). To verbally instruct the patient the dispenser contains a micro-processor controlled voice chip 240. The voice chip contains 90 seconds of addressable messages, which could be prerecorded by a family member, for play back in programmed addressable sequences offering step by step instructions to the patient. At the correct dosing time the micro-processor will trigger a human voice message from the internal voice chip that will call the patient by name and declare that "it is time to take your medication." Referring to FIG. 1, an array of light emitting diodes on the top of the dispenser 67 will be triggered by the micro-processor and begin to blink and flash on-and-off in coordinated fashion with the luminous medication release button 55 on the front panel. Also, a radio frequency signal will be transmitted to the remote alarms throughout the patient's dwelling to alert the patient, if he/she is not in the vicinity of the dispenser. If the patient does not respond to the alarms on the first alerting sequence by pushing the luminous blinking medication release button 55 the whole alerting sequence will repeat itself in one minute. The alerting sequences will continue for a preset number of minutes (typically lasting for 30 to 45 minutes) at which time the program will skip the current dose and reset itself for the next dosing time. Furthermore, the number of doses skipped before the micro-processor initiates telephone contact with the responsible family member or health care giver is a programmable input since it is generally patient dependent. When the patient responds by following the verbal instructions and pushing the luminous medication release button on the front panel the micro-processor will send an activation signal to the solenoid drivers 270 (FIG. 6) which in turn activate the proper solenoid 260 (FIG. 6) and thereby eject the proper canister into the receiving bin 49 (FIG. 1).

The sensors which are built into the present invention dispenser are designed to detect four effects: first, the movement of the ejection arms are monitored 130, as seen in FIG. 2, to insure that if a jam occurs the patient will be notified as well as the health care provider. Secondly, the sensor 27, seen in FIG. 1, in the receiving bin will monitor the presence of a canister to ascertain if it has been ejected properly and if the patient has actually picked-up the canister, at which time the patient is instructed to "pick-up the bottle". The third sensor 155 (FIG. 1) mounted under the top cover 10 or lid will ascertain if the lid has been properly closed for correct operation and will also insure that the clock on the front panel liquid crystal display is in the proper mode to show the correct day, time of day and date. Fourth, the sensor 36 detects if the receiving bin 49 is properly positioned to receive an ejected canister. If the bin is not in its correct position a message will be voiced "to reset the receiving bin".

The conventional telephone line is connected to the dispenser via the modem which is connected to the serial RS 232 interface 220 (FIG. 6) which has direct input into the micro-processor. The health care provider can contact the dispenser at any time to remotely ascertain the medication records of the patient or the dispenser can automatically dial out to the health care giver if a problem arises in the dispenser. In fact, the micro-processor's internal program can be remotely changed in this fashion if the medication regimen must be altered quickly. Furthermore, a common personal computer (PC) or lap top PC may be interfaced to the dispenser on site, or remotely, to automatically down load dispenser information and change internal programming.

Located internally will be the time and dosage selection key board 290 (FIG. 6) and the start button which will start the preprogrammed timing operations for a dosage schedule of daily times, which will be equal to the number of concatenated stacks in the magazine assembly 12 seen in FIG. 1. The unit will be powered by back-up battery or by the standard 120 AC volts available in any household. This dispenser must be manually loaded by a family member, a case worker, or technician. A significant feature is the ability to reload the magazine structure off-line in locations other than where they are used and simply plug-in the magazine when visiting the dispenser. The medication storage mechanisms which is removable so that it may be reloaded at a more convenient place and time. All timing is preset and only requires the key board to be set which will fix the number of doses per day at the initial set-up procedure.

Some of the many advantages of the present invention should now be readily apparent. The smart automatic medication dispenser is an autonomous and fully automated, user friendly, medication dispenser for the home bound patient. Furthermore, it is user friendly, having only one button to push to release a bottle containing all the medications required for that dose, it will deny access to all medication except what is intended for consumption, it is modular in construction and is expandable, it is computer controlled since all timing functions are coordinated in one central computer logic chip, if expanded it can deliver up to 8 doses of medication per day for seven consecutive days or more, it will automatically alert the patient when it is time take his/her medication, it will keep a running record of all medications delivered to the patient; this is a patient compliance indicator, it will be easily reloadable by a simple change of the magazine in which the bottles and medication are housed, and it can automatically communicate two ways with the health care provider via automatic phone dialing capability.

Once it is set up by a health care provider, the entire operation is controlled by a commercial computer chip and will operate in a stand alone mode for a period of one week or more. It will nominally deliver a prescribed mixture of medication up to a 4 times a day and more if needed. This invention will automatically alert the patient at the correct dosing time by voice, acoustic and optical alarms. Also included in the alarm system will be human voice messages, possibly a familiar friendly voice, to prompt the patient to take his/her prescribed medication at the correct times. To directly address the issue of patient compliance, this dispenser will also keep a running electronic record of all delivered medications for the health care provider's records. This dispenser will be easily reloadable by simply changing the magazine in which the bottles are housed. The health care provider or a family member may reload the magazine and easily snap in the entire week's worth of medication into the dispenser housing.

Patient home health care will be greatly aided by this invention as it will alleviate the need for constant and daily health care supervision. Those skilled in the art will appreciate without any further explanation that modifications and variations are possible to the above-disclosed smart automatic medication dispenser within the scope of this invention. Consequently, it should be understood that all such modifications and variations fall within the scope of the following claims.

What is claimed is:

1. A programmable automatic medication dispenser, comprising:

a dispenser main body having a receiving bin;

a medication magazine, detachable from the dispenser main body, having a plurality of stacks, each stack having a plurality of stacked medication canisters, and said detachable medication magazine capable of holding a multi-day, prescribed sequence of medications, as a single transportable unit;

a patient alerting means attached to the dispenser main body;

a plurality of ejection arms;

a computing means that monitors the time of the day, generates a signal to the patient-alerting means at programmed dosage times, and determines a selected medication ejection arm and a selected medication canister;

a patient activated medication release button generating an electrical ejection signal;

a means to translate the electrical ejection signal into a mechanical motion and activate the selected ejection arm to push the selected medication canister from the medication magazine into the receiving bin, whereby, at predetermined dosing times, the selected medication canister is delivered to the patient from the detachable medication magazine.

2. The programmable automatic medication dispenser of claim 1 wherein the means to translate the electrical ejection signal into the mechanical motion is a solenoid.

3. The programmable automatic medication dispenser of claim 1 further comprising a simple front panel comprising:

a single flashing patent activated push button;

a small visual liquid crystal display window showing the time of day;

an LED malfunction light.

4. The programmable automatic medication dispenser of claim 1 wherein the detachable medication magazine further comprises a means to hold liquid and tablet medications.

5. The programmable automatic medication dispenser of claim 1 further comprising a position sensor switch and a means to alert the patient by voice message if the collection bin is not properly positioned to receive the selected medication canister.

6. The programmable automatic medication dispenser of claim 1 further comprising a means for independent ejection for out of sequence delivery of the medication canisters from within the detachable medication magazine.

7. The programmable automatic medication dispenser of claim 1 further comprising a means to detect regiment compliance; and a means to record the deviations of regiment compliance.

8. The programmable automatic medication dispenser of claim 7 wherein the means to detect regiment compliance is a optical sensor.

9. The programmable automatic medication dispenser of claim 1 wherein the computing means further comprises:

a means to connect to a remote computer; and a means to transfer information to and from a home-based programmable automatic medication dispenser and the remote computer.

10. The programmable automatic medication dispenser of claim 9 further comprising a means to automatically notify the remote computer after a set number of missed doses has occurred.

11. The programmable automatic medication dispenser of claim 9 wherein the remote computer and the home-based computer further comprise a means to remotely change the programming and medication regiment of the home-based programmable automatic medication dispenser.

12. The programmable automatic medication dispenser of claim 9 wherein the medication magazine further comprises a built-in electronic identification circuitry to communicate with the embedded central computer to identify itself and the patient as well as relay information on daily dosage times regarding the medication contained within the magazine.

13. The programmable automatic medication dispenser of claim 1 further comprising a means to remotely monitor the programmable automatic medication dispenser and patient usage of the dispenser.

14. The programmable automatic medication dispenser of claim 13 wherein the means to remotely monitor the patient of the dispenser is a video camera.

15. The programmable automatic medication dispenser of claim 1 further comprises a fault tolerant means to monitor and correct faulty dispenser behavior in the presence of a single fault and perform a safe shut down of the unit in the presence of multiple faults.

16. The programmable automatic medication dispenser of claim 15 wherein the fault tolerant means comprises a watchdog timer.

17. The programmable automatic medication dispenser of claim 15 further comprising a means to detect any dispenser malfunctions and enable a warning indicator light.

18. The programmable automatic medication dispenser of claim 1 further comprising a means to persistently alert the patient of medication time and said persistent alerting means being capable of remote location from the dispenser main body.

19. The programmable automatic medication dispenser of claim 18 wherein a signal to the means to persistently alert the patient of medication time is a Radio Frequency signal.

20. The programmable automatic medication dispenser of claim 18 wherein the persistent alerting means is an acoustic alerting means.

21. The programmable automatic medication dispenser of claim 18 wherein the persistent alerting means is an optical signal.

22. The programmable automatic medication dispenser of claim 18 wherein the persistent alerting means is a message printed out on a playing TV.

23. The programmable automatic medication dispenser of claim 18 further comprising a means to terminate the alarms if the patient does not activate the patient activated medication release button within a preset time interval and a means to reset the dispenser to the next sequence of medications.

24. The programmable automatic medication dispenser of claim 1 further comprising a means to give step by step voice directions saying that it is time to take the medication and leading patients through a delivery sequence.

25. The programmable automatic medication dispenser of claim 24 wherein the means to give step by step voice directions is a familiar voice known to the patient.

* * * * *